US005175988A

United States Patent [19]

Kibe

[11] Patent Number: 5,175,988

[45] Date of Patent: Jan. 5, 1993

[54] RING FOR SPINNING MACHINERY

[75] Inventor: Shigeru Kibe, Amagasaki, Japan

[73] Assignee: Kanai Juyo Kogyo Company Ltd., Hyogo, Japan

[21] Appl. No.: 845,532

[22] Filed: Mar. 4, 1992

Related U.S. Application Data

[63] Continuation-in-part of Ser. No. 610,321, Nov. 8, 1990, abandoned, which is a continuation of Ser. No. 370,045, Jun. 22, 1989, abandoned.

[30] Foreign Application Priority Data

Jun. 23, 1988 [JP] Japan ..... 63-155445

[51] Int. Cl.[5] ..... D01H 7/60

[52] U.S. Cl. ..... 57/119

[58] Field of Search ..... 57/119, 118, 120, 137; 384/94, 907.1

[56] References Cited

U.S. PATENT DOCUMENTS 3,696,875 10/1972 Cortes ..... 175/329
4,345,798 8/1982 Cortés ..... 384/907.1 X
4,698,958 10/1987 Nakano et al. ..... 57/119

FOREIGN PATENT DOCUMENTS 1-321925 12/1989 Japan .

*Primary Examiner*—Joseph J. Hail, III
*Attorney, Agent, or Firm*—Wenderoth, Lind & Ponack

[57] ABSTRACT

A ring for use in spinning machinery such as ring spinning machines and twisting machines, which is usable at a high spindle revolutionary speeds of 20,000 r.p.m. The ring comprises a ring flange, a neck part, a collar and a trunk part. The trunk part has a ring fitting part and is provided, at the surface which contacts at least the ring traveller, with a composite plated layer of nickel and phosphorous alloy containing hard fine grains. The ring is further treated with heating and polishing processes to increase hardness and smoothness of the surface to thereby improve anti-wearing properties and heat-resistance properties.

11 Claims, 5 Drawing Sheets

RING FOR SPINNING MACHINERY

This application is a continuation-in-part of now abandoned application Ser. No. 07/610,321 filed on Nov. 8, 1990, which is a continuation of now abandoned application Ser. No. 07/370,045 filed on Jun. 22, 1989.

BACKGROUND OF THE INVENTION

1. Field of the Invention

The present invention relates to a ring for spinning machinery, used in the fine spinning work, and exhibiting excellent characteristics especially in high speed fine spinning.

2. Description of the Prior Art

Heretofore, low carbon steel has been used in rings for spinning machinery, and carburizing hardening treatment has been applied thereon as a hardening treatment. However, in the above-described ring, when the spindle of a fine spinning machine is used at high speeds such as 20,000 r.p.m. or more, there has been a problem that the frictional resistance between the ring and the traveller increases, and the frictional heat rapidly increases to bring about the baking and blow off of the traveller after a short period of time, to make continuous operation impossible.

In order to solve the above-described problems, such a ring in which a composite plated layer is formed with hard fine grains co-separated on the surface of the flange (such as, for example, in U.S. Pat. No. 4,698,958) has been considered. However, when the thickness of the plated layer of the composite plated layer is increased, surface roughness of the plated surface becomes coarse due to the hard fine grains being embedded in the plated layer, and there is a problem that a sufficient effect cannot be obtained at high spindle revolution speeds of more than 24,000 r.p.m.

SUMMARY OF THE INVENTION

The object of the present invention is to improve the anti-wearing properties of the ring and its baking resistance against the traveller, by crystallizing the nickel alloy plated on the ring surface as the matrix of the composite plated layer. According to this invention, plated layer hardness is tremendously enhanced and, at the same time, the adhering force of hard fine grains to the nickel alloy as the matrix is strengthened.

A further object of the present invention is to improve the sliding properties of the traveller by depositing hard fine grains on the surface of the ring which the traveller contacts and slides on such that the hard fine grains cover 5–40% of the surface area of the ring, and by making the surface roughness less than 0.2 μm Ra.

In order to attain the above-described object, the present inventors have carried out research in connection with plating and surface finishing to be applied to the ring surface. As a result, the present invention has been achieved.

DESCRIPTION OF THE PREFERRED EMBODIMENTS

In the following, explanation will be given on embodiments of the present invention with reference to the drawings.

Figure 1:
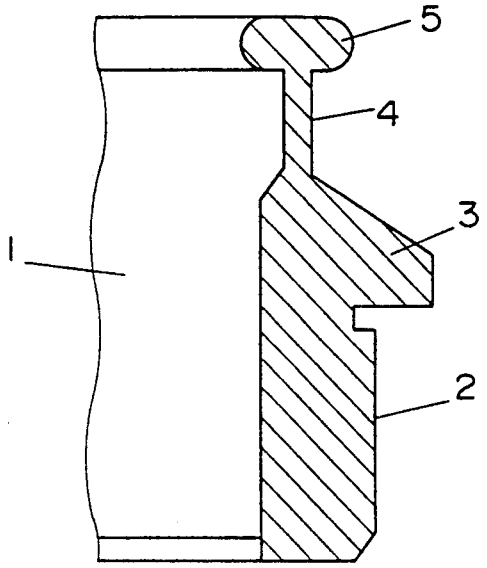
FIG. 1 is a partly broken sectional diagram showing an embodiment of the ring for use in a spinning machine according to the present invention.

A steel base material (S15 CK) of cylindrical shape was cut and processed to form a ring 1 (FIG. 1), and the ring was subjected to carburizing hardening and surface treatment.

The above-described ring had such a structure that it had a collar 3 on the external circumferential surface of the cylindrically shaped trunk part, and further, had a ring flange 5 on which the ring traveller slides, at the top of the ring neck part 4.

Figure 2:
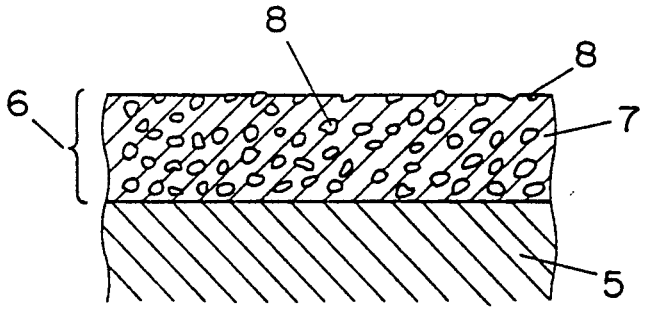
FIG. 2 is an enlarged view diagram for the essential part of the ring for use in a spinning machine according to the present invention.

The above-described ring 1, after being subjected to the pre-treatment of the plating such as degreasing and acid cleaning on at least the surface of the ring flange 5, was covered by forming a composite plated layer 6 dispersed and separated with silicon carbide as a co-separating substance in the matrix of nickel-phosphorous alloy 7 (FIG. 2).

The composite plated layer 6 was formed by electroless plating with the dispersion of the silicon carbide 8 of a particle size of 1 μm as hard fine grains in such an amount that its content became approximately 4% by weight, in the matrix of the nickel-phosphorous alloy 7.

The ring 1 on which the composite plated layer 6 was formed was subjected to heat treatment in a heat treating furnace at a temperature of 400° C. for about one hour to crystallize the nickel-phosphorous of the matrix. Due to this crystallization, the composite plated layer could obtain the high hardness of 1000 Hv. Moreover, the closely adhering properties of the co-separating substance, silicon carbide, to the matrix was strengthened.

The ring flange 5, to which the ring traveller of the ring 1 contacts and slides, was formed by subjecting it to polish processing by use of lapping so as to have the thickness of the composite plated layer of 30 μm. By carrying out polish processing, hard fine grains were exposed on the surface of the ring flange 5, and the flange was finished to become a smooth surface with a surface roughness of less than 0.2 μm.

By carrying out the polishing process as described above, exposed portions of the hard fine grains were polished, or were removed such that the surface of the ring became smooth with a portion of the exposed hard fine particles protruding slightly above the surface, and a portion of the hard fine particles being exfoliated to leave minute recesses in the surface, as shown in FIG. 2.

Figure 4A:
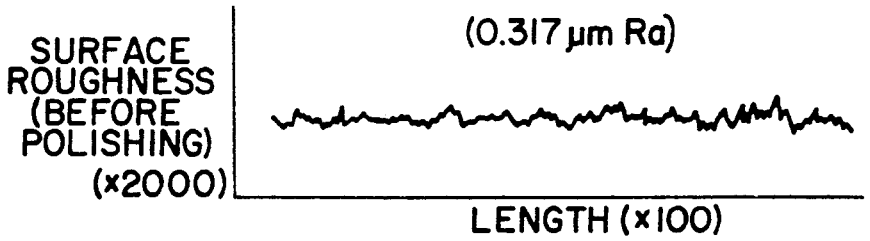
FIG. 4*a* is a curve showing the surface roughness of the composite plated layer before the polishing process.
Figure 4B:
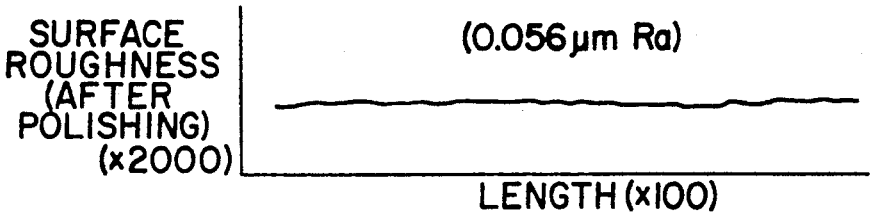
FIG. 4*b* is a curve showing the surface roughness of the composite plated layer after the polishing process.
Figure 5A:
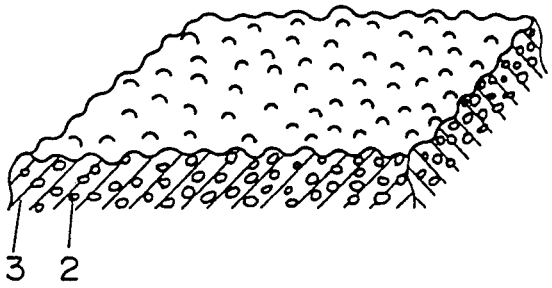
FIG. 5*a* is an explanatory diagram showing the surface state of the composite plated layer before the polishing process.
Figure 5B:
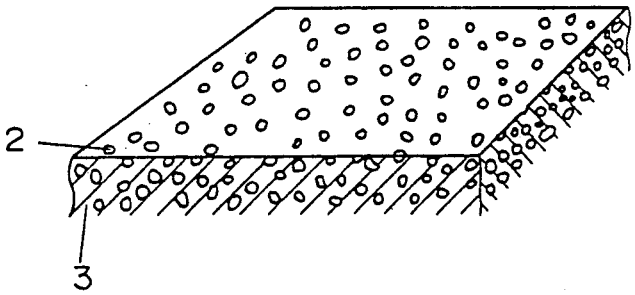
FIG. 5*b* is an explanatory diagram showing the surface state after the polishing process.

In FIGS. 4*a* and 4*b* are shown the data corresponding to the surface roughness before and after the polishing process. Also, in FIG. 5*a*, the surface state of the ring flange 5 before the polishing process is shown, and in FIG. 5*b*, the surface state of the ring flange after the polishing process is shown. The outermost surface of the composite plated layer 6 shows the co-existant state of the hard fine particles of the silicon carbide 8 exposed in the matrix, nickel-phosphorous alloy 7.

The substance which is preferred for use as the hard fine particles and is co-separated in the composite plated layer 6, is silicon carbide 8 which is very hard and has large anti-chemical properties and anti-wearing properties, and good thermal conductivity. The ring 1 on which the above-described composite plated layer 6 is formed has an advantage in that it easily radiates the friction heat generated in the time when the ring traveller runs on the ring flange, and thus extends the life of the traveller.

Although silicon carbide has been used as the hard fine particles, at least one kind or two or more kinds of tungsten carbide, boron nitride. or aluminum oxide can also be used. Also, the particle diameter of the hard fine particles is preferably in the range of 0.2 μm to 3 μm, and when it is less than 0.2 μm, the anti-wearing properties of the ring are inferior, and when it exceeds 3 μm, hard fine particles drop out from the composite plated layer, and the radiation of the friction heat becomes worse, thereby shortening the life of the traveller, and lowering the anti-wearing properties of the ring markedly.

The content percentage of the hard fine particles included in the matrix of the composite plated layer is 2–15% by weight. When the content percentage is less than 2%, the anti-wearing property of the ring is inferior, and when it exceeds 15%, the rate of occupation of the hard fine particles on the surface of the composite plated layer is larger such that the sliding properties of the ring traveller deteriorate. This results in traveller baking after a short period of use, and frequent yarn cuts. The percentage of the area that the particles occupy on the surface and along a cross section of the ring flange is observed to be 5–40%, preferably 10–30%. The percentage of the area that the silicon carbide occupies in the abovedescribed embodiment is 19.5% along the cross section, and 25.6% at the surface. When the percentage of the area that the silicon carbide covers is less than 5%, the anti-wearing property of the ring deteriorates, and when it exceeds 40%, the sliding property of the ring traveller deteriorates to cause baking of the traveller after a short period of use and frequent yarn cuttings.

Although the thickness of the composite plated layer 6 was taken as 30 μm, a thickness of 5–35 μm is preferable. When the thickness is less than 5 μm, the anti-wearing properties when the spindle revolution speed is more than 20,000 r.p.m. deteriorate, and when it exceeds 35 μm, the treating time of the composite plating becomes extremely long which makes production cost of the ring high.

It is more desirable that the thickness of the composite plated layer be 16–35 μm, since the life of high speed spinning can thereby be prolonged.

The heat treatment conditions for the ring 1 formed with the composite plated layer 6 were such that the heat treatment time at a temperature of 400° C. was about one hour, but the heat treatment may be effected at a temperature in the range of 320°–420° C. and for a heat treatment time of about one to two hours.

Figure 3:
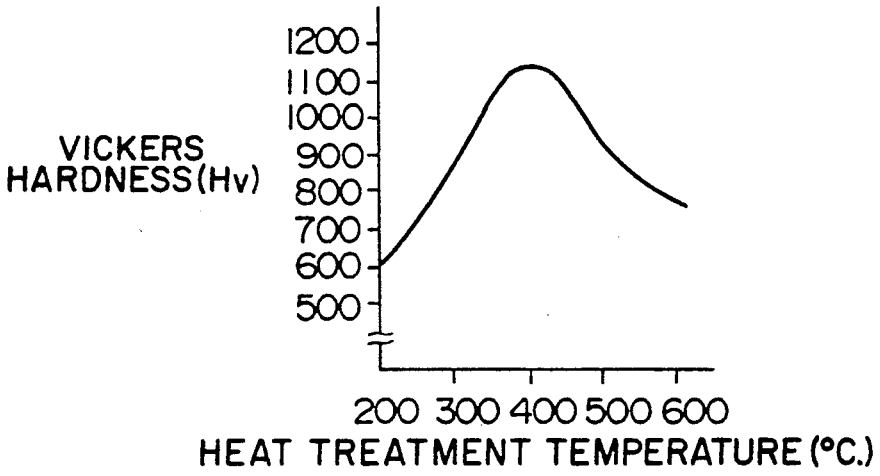
FIG. 3 is a curve showing the relationship between the heat treatment temperature and the hardness of the nickel-phosphorous alloy coated layer.
Figure 7:
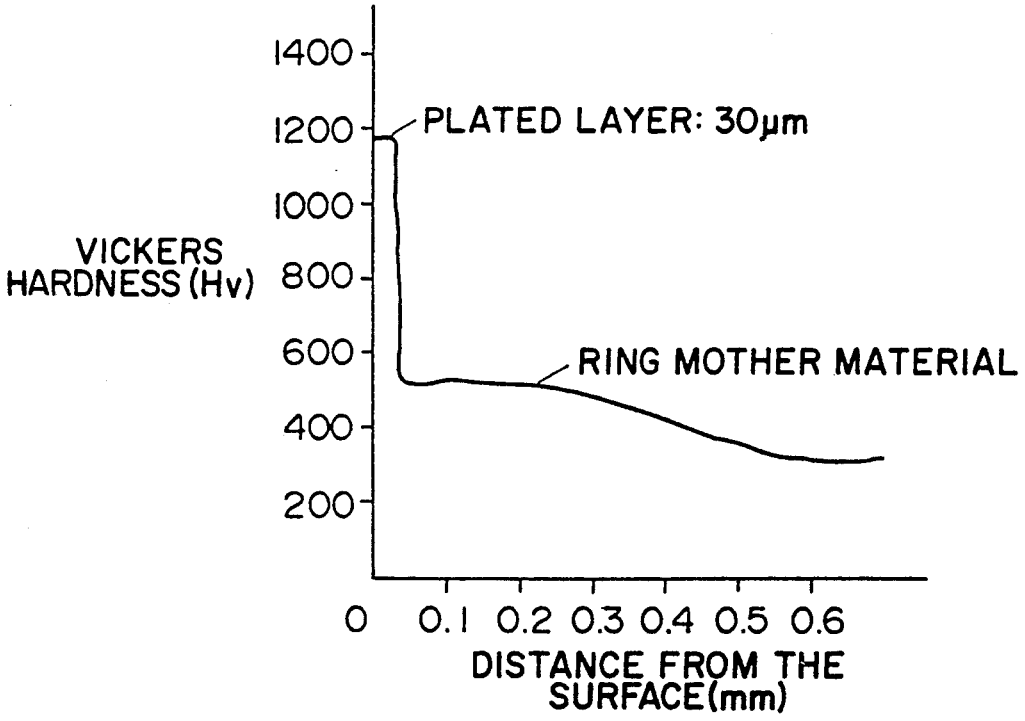
FIG. 7 is a curve showing the relationship between the distance from the surface of the ring according to the present invention and the Vickers hardness thereof.

By effecting heat treatment under the above-described heat treating conditions, extreme hardness of the coated layer hardness in the range of 900–1200 Hv can be obtained. Additionally, such treatment provides the mother material (i.e. the steel starting material) with a hardness of 500 to 550 Hv from the surface of the ring to the depth of about 0.3 mm so that the anti-wearing properties of the ring are improved (FIGS. 3 and 7).

The hardness of the mother material immediately below the composite plated layer is preferably in the range of 500–650 Hv.

The surface of the ring on which the ring traveller contacts and slides was polished to make the surface roughness of the surface of the ring less than 0.2 μm Ra. When the surface roughness of the composite plating exceeds 0.2 μm Ra, the running of the ring traveller is disturbed, and high speed operation cannot be carried out. As described above, by making the surface roughness less than 0.2 μm Ra, not only is the running of the ring traveller smoother, but also the frictional resistance of the ring traveller at high revolution speeds zone of the spindle is reduced. This occurs because the hard fine particles have extreme hardness and excellent anti-wearing properties and are exposed on the outermost surface of the composite plated layer to coexist with the matrix.

For the nickel alloy to be used as the matrix, nickel-phosphorous alloy, nickel-tungsten-phosphorous alloy, and the like are used.

Figure 8:
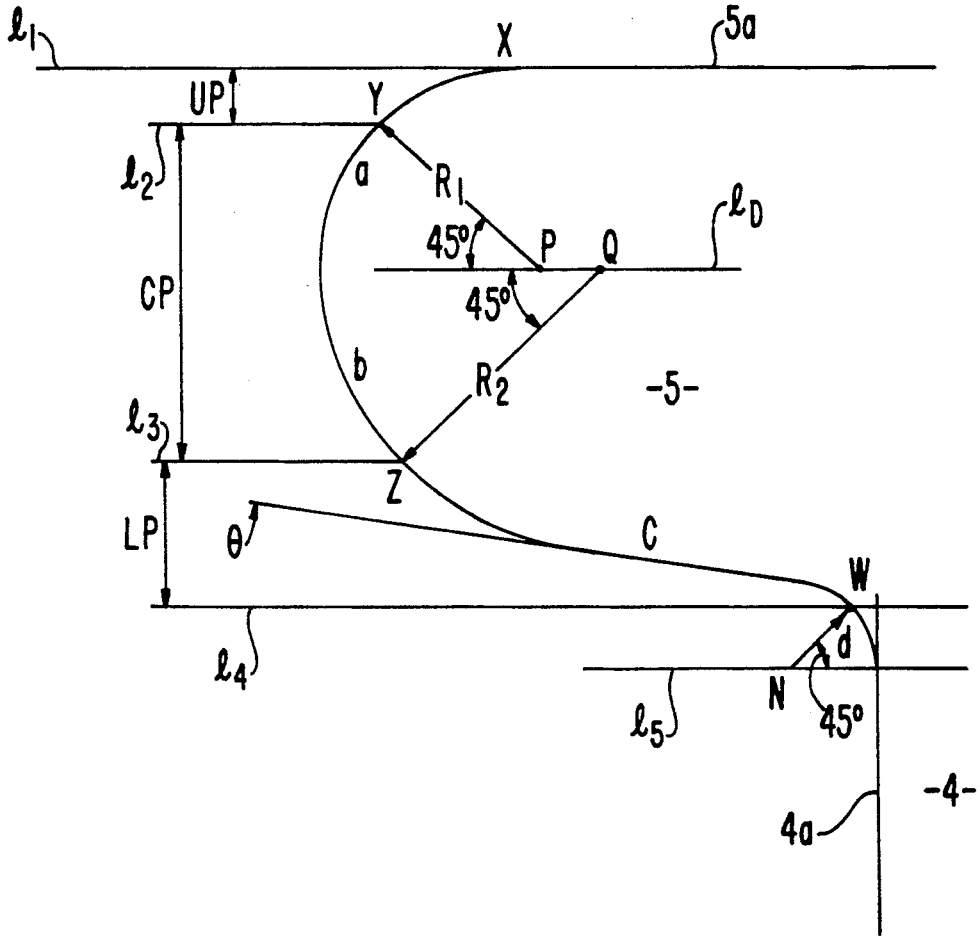
FIG. 8 is an enlarged schematic diagram of an upper portion of the ring shown in FIG. 1.

In the preferred form of the invention, the layer 6 is formed so that the silicon carbide (hard fine particles) 8 is dispersed in the matrix material (nickel-phosphorus allog) 7 more densely at the central part of the inner portion of the flange 5 than at the upper and lower parts of the inner portion of the flange 5. More specifically with reference to FIG. 8, the inner surface of the flange 5 is composed of a circular arc a having a radius of curvature $R_1$, a circular arc b having a radius of curvature $R_2$ and a straight line c having an angle of inclination Θ, which is preferably 8–9 degrees. More particularly, the inner surface of the flange 5 is formed by connecting the two circular arcs a and b, connecting the circular arc b with the straight line c and connecting the straight line c with the upper portion of the neck part 4 by way of a circular arc d. In FIG. 8, line $l_1$ is colinear with the top surface 5*a* of the flange 5, and lines $l_0$, $l_2$, $l_3$, $l_4$ and line $l_5$ are parallel to the line $l_1$. X is the intersection of line $l_1$ with the flange. Y is the intersection of the circular arc a and a straight line drawn from P (center of curvature of the circular arc a) at a 45° angle upwardly of the line $l_0$. Z is the intersection of the circular arc b and straight line drawn from Q (center of curvature of the circular arc b) at a 45° angle downwardly of the line $l_0$. W is the intersection of the arc d and a straight line drawn from N (center of curvature of the circular arc d) at a 45° angle upwardly from the line $l_5$.

The upper part of the inner surface of the flange is the circular arc part between X and Y and the central part of the inner surface of the flange is the circular arc part between Y and Z. The lower part of the inner surface of the flange is generrally the part between Z and W, but in some cases can be the part between Z and approximately the intersection of the lower part of the circular arc d and the inner wall surface 4a of the upper part of the neck part 4.

In the preferred form of the invention, the distance UP between line $l_1$ and line $l_2$ is 10±5% of the distance between $l_1$ and $l_4$, and the distance CP between $l_2$ and $l_3$ is 75±10% of the distance between line $l_1$ and $l_4$. The remainder LP of the distance between $l_1$ and $l_4$ is normally the vertical distance along the lower part of the flange. However, the vertical distance along the lower part is not necessarily equal to the distance between $l_1$ and $l_4$ minus the vertical distance along the upper and central parts, because, as noted above, the lower extreme of the lower part can, in some cases, be below the line $l_4$.

COMPARATIVE EXAMPLE

A comparative test was carried out by using a ring (A) for a spinning machine according to the present invention, a ring (B) for a spinning machine obtained by effecting case hardening by carburizing the conventional low carbon steel, and a conventional ring (C) which was subjected to the above-described composite plating and has a surface roughness of 0.4 μm Ra.

Test conditions:

Yarn: ester/cotton 45's

Ring: 3.2 mm×41 mmϕ×57.5 mmϕ

Ring traveller: YS-2/hf 11/0 (nickel plated material)

Spindle revolution speed: 16,000–30,000 r.p.m.

Figure 6:
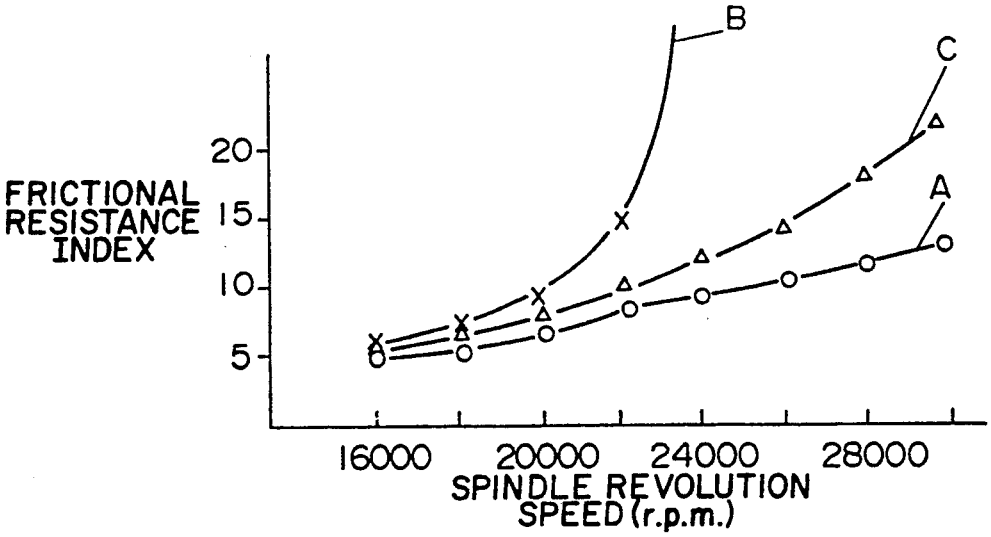
FIG. 6 is a curve showing the relationship between the spindle revolution speed and the index of the wear resistance.

In FIG. 6 are shown the friction resistance indices of the ring traveller and the ring at the revolution speed of each spindle under the above-described spinning conditions.

Up to a spindle revolution of 16,000–18,000 r.p.m., there is not a large difference between the ring (A) of the present invention and the conventional rings (B) and (C), and no remarkable difference was perceived in the frictional resistance indices.

When the spindle revolution speed exceeds 18,000 r.p.m., the frictional resistance indices rose remarkably for the conventional ring (B), but for the ring of the present invention, there was no abrupt rise, and the rise was slow. Further, when the rotation speed of the conventional ring (B) is more than 22,000 r.p.m., the frictional resistance indices rise rapidly, and when it is more than 24,000 r.p.m., the baking and wear of the ring traveller makes continuous spinning impossible. Also, for the conventional ring (C), frictlonal resistance indices rise rapidly at in the high revolution speeds of more than 24,000 r.p.m. thereby markedly increasing the number of yarn cuts. For the ring (A) of the present invention, even at super high revolution speed of 24,000–30,000 r.p.m., no rapid rise of the index was seen, stabilized low frictional resistance indices were shown, the wear of the ring traveller was almost not generated, and continuous spinning could be carried out (FIG. 6).

EFFECT OF THE INVENTION

In the present invention, a composite plated layer is formed by making hard fine particles as a co-separating substance and the nickel-phosphorous containing nickel alloy as a matrix. The hardness of the matrix is at 900–1200Hv, hard fine particles are exposed on the surface thereof, and the surface roughness is less than 0.2 μm Ra, so thus the ring traveller fits well even at very high rotation speeds of the spindle of more than 24,000 r.p.m., and stabilized continuous operation can be carried out. Moreover, baking of the ring traveller does not occur, and the life of the ring traveller is prolonged.

Since hard fine particles are exposed on the surface of the ring in contact with the ring traveller in such an amount that it covers 5–40% of the surface area, the anti-wearing properties of the ring are improved, and the life of the ring is prolonged.

By carrying out the plating pretreatment sufficiently, and by effecting heat treatment after the plating treatment, peeling out of the composite plated layer does not occur, and the performance of the ring can be maintained for a long period.

Further, since the hardness of the ring mother material immediately below the composite plated layer is made as 500–650 Hv, there are such excellent effects that there is little wear on the ring, the life of the ring is prolonged, and the like.

What is claimed is:

1. A ring for use in spinning machinery, comprising:

an annular flange having an inner portion and an outer portion, said inner portion including an upper part, a lower part, and a central part between said upper and lower parts;

wherein said annular flange is formed of a base material and a composite plated layer plated on said base material, said plated layer being formed of a nickel-phosphorus matrix material having hard fine particles of 0.2–3 μm particle diameter co-separated therein;

wherein some of said hard fine particles protrude slightly above the surface of said nickel-phosphorus matrix material such that a portion of an exposed surface of said plated layer consists of protruding hard fine particles;

wherein a portion of the exposed surface of said plated layer consists of minute recesses from which hard fine particles have been exfoliated; and wherein said hard fine particles are dispersed in said matrix material more densely at said central part of said inner portion of said flange than at said upper and lower parts of said inner portion of said flange.

2. A ring as recited in claim 1, wherein a vertical distance along said upper part of said inner portion of said annular flange is approximately 10% of a vertical distance along said inner portion of said annular flange.

3. A ring as recited in claim 12, wherein a vertical distance along said central part of said inner portion of said annular flange is approximately 75% of the vertical distance along said inner portion of said annular flange.

4. A ring as recited in claim 1, further comprising a neck part extending downwardly of said annular flange and having an inner wall surface; and wherein an external face of said inner portion of said annular flange is defined along a first arc extending tangentially with a top surface of said annular flange and downwardly thereof, a second arc extending tangentially with said first arc and downwardly thereof, a third arc extending tangentially with and upwardly from said inner wall surface of said neck part, and a straight line extending tangentially with and between said second and third arcs.

5. A ring as recited in claim 4, wherein said upper part of said inner portion of said annular flange is defined between an intersection of the top surface of said annular flange of said first arc, and an intersection of said first arc and a straight line extending from a center of curvature of said first arc and upwardly therefrom at a 45 degree angle from horizontal; and said central part of said inner portion of said annular flange is defined between a lower boundary of said upper part, and an intersection of said second arc and a straight line extending from a center of curvature of said second arc and downwardly therefrom at a 45 degree angle from horizontal.

6. A ring as recited in claim 5, wherein said lower part of said inner portion of said annular flange is defined between a lower boundary of said central part, and an intersection of said third arc and a horizontal line extending from an intersection of said third arc and a straight line extending from a center of curvature of said third arc and upwardly therefrom at a 45 degree angle from horizontal.

7. A ring as recited in claim 5, wherein said lower part of said inner portion of said annular flange is defined between a lower boundary of said central part, and approximately an intersection of said third arc and said inner wall surface of said neck part.

8. A ring as recited in claim 1, wherein said exposed surface has an overall average surface roughness of less than 0.2 μm.

9. A ring as recited in claim 1, wherein said layer is 5–35 μm thick.

10. A ring as recited in claim 9, wherein said layer is 16–35 μm thick.

11. A ring as recited in claim 1, wherein said hard fine particles are selected from at least one of the group consisting of silicon carbide, tungsten carbide, boron nitride and aluminum oxide.

* * * * *